US012448976B2

(12) United States Patent
Saegusa

(10) Patent No.: US 12,448,976 B2
(45) Date of Patent: Oct. 21, 2025

(54) VACUUM PUMP AND CONTROL APPARATUS OF VACUUM PUMP WITH WATER LEAKAGE PREVENTION BETWEEN THE PUMP MAIN BODY AND CONTROL APPARATUS

(71) Applicant: Edwards Japan Limited, Chiba (JP)

(72) Inventor: Kengo Saegusa, Chiba (JP)

(73) Assignee: Edwards Japan Limited, Chiba (JP)

( * ) Notice: Subject to any disclaimer, the term of this patent is extended or adjusted under 35 U.S.C. 154(b) by 209 days.

(21) Appl. No.: 17/441,555

(22) PCT Filed: Mar. 13, 2020

(86) PCT No.: PCT/JP2020/011073

§ 371 (c)(1),
(2) Date: Sep. 21, 2021

(87) PCT Pub. No.: WO2020/195944

PCT Pub. Date: Oct. 1, 2020

(65) Prior Publication Data

US 2022/0170470 A1 Jun. 2, 2022

(30) Foreign Application Priority Data

Mar. 28, 2019 (JP) ..... 2019-063520

(51) Int. Cl.
*F04D 19/04* (2006.01)
*F04D 25/06* (2006.01)
(Continued)

(52) U.S. Cl.
CPC ..... *F04D 19/042* (2013.01); *F04D 25/068* (2013.01); *F04D 25/0693* (2013.01); *F04D 29/522* (2013.01); *F04D 29/70* (2013.01)

(58) Field of Classification Search
None
See application file for complete search history.

(56) References Cited

U.S. PATENT DOCUMENTS 5,382,752 A * 1/1995 Reyhan ..... H02G 3/088 174/665
5,971,725 A * 10/1999 de Simon ..... F04D 25/068 417/423.4

(Continued)

FOREIGN PATENT DOCUMENTS

EP 1843043 B1 * 5/2018 ..... F04D 17/168
JP 2006250033 A * 9/2006 ..... F04D 19/04

(Continued)

OTHER PUBLICATIONS

Machine translation of JP-2019178994 (Obtained from USPTO Search Copyright 2023 Clarivate Analytics) (Year: 2023).*

(Continued)

*Primary Examiner* — Dominick L Plakkoottam
*Assistant Examiner* — Geoffrey S Lee
(74) *Attorney, Agent, or Firm* — Theodore M. Magee; Westman, Champlin & Koehler, P.A.

(57) ABSTRACT

A vacuum pump in which a pump main body and a control apparatus that controls the pump main body are integrated with each other. The control apparatus includes a cylindrical portion which protrudes from a chassis of the control apparatus and inside which a cable that connects the pump main body and the control apparatus to each other is passed. A height of the cylindrical portion exceeds a height of a gap formed between a bottom portion of the pump main body and the chassis of the control apparatus.

10 Claims, 6 Drawing Sheets

(51) Int. Cl.
*F04D 29/52* (2006.01)
*F04D 29/70* (2006.01)

(56) References Cited

U.S. PATENT DOCUMENTS

| | | | | |
|---|---|---|---|---|
| 8,651,838 | B2 * | 2/2014 | Birkenstock | F04D 29/083 417/423.4 |
| 9,267,392 | B2 * | 2/2016 | Schroder | F01D 25/00 |
| 11,215,187 | B2 * | 1/2022 | Saegusa | F04B 37/16 |
| 2002/0029809 | A1 * | 3/2002 | Miyazoe | F15B 13/086 137/554 |
| 2012/0034066 | A1 * | 2/2012 | Kogame | F04D 19/042 415/90 |
| 2016/0025096 | A1 * | 1/2016 | Shi | F04D 25/06 417/423.1 |
| 2016/0195098 | A1 * | 7/2016 | Omori | F04D 29/281 417/423.7 |
| 2019/0242387 | A1 * | 8/2019 | Saegusa | F04D 19/04 |
| 2019/0309760 | A1 * | 10/2019 | Omori | F04D 19/042 |

FOREIGN PATENT DOCUMENTS

| | | | | | |
|---|---|---|---|---|---|
| JP | 3138105 | U | | 12/2007 | |
| JP | 2013100760 | A | * | 5/2013 | F04D 19/04 |
| JP | 2015048734 | A | | 3/2015 | |
| JP | 2016207396 | | * | 10/2016 | |
| JP | 2017002729 | A | | 1/2017 | |
| JP | WO-2018/074191 | | * | 9/2017 | |
| JP | 2018066368 | A | | 4/2018 | |
| JP | 2018115631 | A | | 7/2018 | |
| JP | 2019178994 | A | * | 10/2019 | G01C 19/5607 |
| KR | 20190066009 | A | * | 6/2019 | |
| WO | WO-2007013274 | A1 | * | 2/2007 | F04D 19/042 |
| WO | 2008096622 | A1 | | 8/2008 | |
| WO | 2012053270 | A1 | | 4/2012 | |

OTHER PUBLICATIONS

Machine translation of EP-1843043 (Obtained from USPTO Search Copyright 2023 Clarivate Analytics) (Year: 2023).*
Machine translation of JP2013100760 (Obtained from http://worldwide.espacenet.com ) (Year: 2023).*
Machine translation of WO-2007013274 (Obtained from USPTO Search Copyright 2023 Clarivate Analytics) (Year: 2023).*
Machine Translation of JP-2006250033 (Obtained from USPTO Search) (Year: 2024).*
Machine Translation of Saegusa KR20190066009 (Obtained from USPTO Search) (Year: 2024).*
Translation of WO 2007/013274 Okudera (Obtained from USPTO Search) (Year: 2025).*
European Communication dated Nov. 17, 2022 and Search Report dated Nov. 7, 2022 for corresponding European application Serial No. EP20777711, 6 pages.
PCT International Search Report dated Jun. 9, 2020 for corresponding PCT application Serial No. PCT/JP2020/011073, 2 pages.
PCT International Written Opinion dated Jun. 9, 2020 for corresponding PCT application Serial No. PCT/JP2020/011073, 3 pages.

* cited by examiner

VACUUM PUMP AND CONTROL APPARATUS OF VACUUM PUMP WITH WATER LEAKAGE PREVENTION BETWEEN THE PUMP MAIN BODY AND CONTROL APPARATUS

CROSS-REFERENCE OF RELATED APPLICATION

This application is a Section 371 National Stage Application of International Application No. PCT/JP2020/011073, filed Mar. 13, 2020, which is incorporated by reference in its entirety and published as WO 2020/195944A1 on Oct. 1, 2020 and which claims priority of Japanese Application No. 2019-063520, filed Mar. 28, 2019.

BACKGROUND

The present invention relates to a vacuum pump and a control apparatus of the vacuum pump and, in particular, to a vacuum pump and a control apparatus of the vacuum pump which inexpensively realizes a structure that is less likely to be infiltrated by water droplets without using a sealing material and which is equipped with a structure that enables a pump main body and the control apparatus to be readily separated and enables maintenance to be readily performed.

With recent developments in electronics, there is a rapidly growing demand for semiconductors such as memories and integrated circuits.

These semiconductors are manufactured by doping an extremely pure semiconductor substrate with an impurity to impart an electric property to the semiconductor substrate, forming a minute circuit on the semiconductor substrate by etching, or the like.

In addition, such operations must be performed inside a chamber in a high-vacuum state in order to circumvent the effect of airborne dust and the like. While vacuum pumps are generally used to exhaust the chamber, in particular, a turbo-molecular pump which is one of such vacuum pumps is frequently used from the perspectives of a small amount of residual gas, easy maintenance, and the like.

In addition, a semiconductor manufacturing process includes a large number of steps in which various process gases are caused to act on a substrate of a semiconductor, and a turbo-molecular pump is used not only to vacuumize the inside of a chamber but also to exhaust such process gases from the chamber.

The turbo-molecular pump is constituted by a pump main body and a control apparatus which controls the pump main body. In addition, conventionally, for the purpose of omitting an external cable for connecting the pump main body and the control apparatus to each other, configurations such as described in Japanese Patent Application Laid-open No. 2006-250033 and Japanese Patent Application Laid-open No. 2018-115631 are known in which a control apparatus is integrated with a side portion or a bottom portion of the pump main body.

The discussion above is merely provided for general background information and is not intended to be used as an aid in determining the scope of the claimed subject matter. The claimed subject matter is not limited to implementations that solve any or all disadvantages noted in the background.

SUMMARY

A pump main body or a semiconductor manufacturing apparatus is often provided with a cooling mechanism that utilizes water cooling. Therefore, when a control apparatus is integrated with a side portion of the pump main body, there is a risk that water droplets may infiltrate into the control apparatus in the event of a water leak or condensation around the pump main body. For this reason, the control apparatus must be equipped with a drip-proof structure and, in the case of Japanese Patent Application Laid-open No. 2006-250033, a watertight sealing material is disposed between a casing of the control apparatus and a base portion.

However, the watertight sealing material is expensive and causes an increase in cost.

In addition, the integrated pump main body and the control apparatus are sometimes separated on-site during maintenance such as when only an internal circuit is to be replaced. Therefore, a structure that enables easy separation and easy handling while providing a drip-proof structure as described above is desired.

Furthermore, when a gap $\sigma$ is provided between the bottom surface (lower surface) of the pump main body and a lid plate of a control unit in order to provide heat insulation between the pump main body and the control unit as described in Japanese Patent Application Laid-open No. 2018-115631, there is a risk that water droplets due to a water leak, condensation, or the like from a cooling mechanism may infiltrate into a control apparatus through the gap $\sigma$ when separating the control apparatus.

The present invention has been made in consideration of such conventional problems and an object thereto is to provide a vacuum pump and a control apparatus of the vacuum pump which inexpensively realizes a structure that is less likely to be infiltrated by water droplets without using a sealing material and which is equipped with a structure that enables a pump main body and the control apparatus to be readily separated and enables maintenance to be readily performed.

In order to achieve the object described above, the present invention provides a vacuum pump in which a pump main body and a control apparatus that controls the pump main body are integrated with each other, wherein the control apparatus includes a cylindrical portion which protrudes from a chassis of the control apparatus and inside which a cable that connects the pump main body and the control apparatus to each other is passed, and a height of the cylindrical portion exceeds a height of a gap formed between a bottom portion of the pump main body and the chassis of the control apparatus.

Cooling by a water-cooled tube may cause condensation to form around the pump main body. In addition, there is a risk that water droplets may leak from the water-cooled tube during maintenance. Leaked water droplets are highly likely to infiltrate into the gap. Since the height of the cylindrical portion exceeds the height of the gap formed between the bottom portion of the pump main body and the chassis of the control apparatus, water droplets filling the gap are prevented from infiltrating from the inside of the cylindrical portion.

Accordingly, safety of circuits during maintenance work can be ensured. In addition, a drip-proof structure can be realized with a simple configuration without using a sealing material.

In addition, the present invention is the invention of the vacuum pump, wherein the pump main body includes a relay chamber which houses a relay substrate to which an end portion of the cable is connected, and the relay chamber is provided with a detachable cover.

Removing the cover enables maintenance work in the relay chamber to be performed with ease. The pump main body and the control apparatus can be readily separated from each other by detaching the end of the cable from the relay substrate.

Furthermore, the present invention is the invention of the vacuum pump, wherein a detachable plate that fastens the pump main body and the control apparatus to each other is provided in the bottom portion of the pump main body.

Providing the plate in the bottom portion of the pump main body enables the pump main body and the control apparatus to be integrated by simply changing the plate even when sizes of the pump main body and the control apparatus differ from each other. Therefore, for example, a single control apparatus can be freely combined with pump main bodies of different capacities. The plate is detachably fastened to the pump main body.

Furthermore, the present invention is the invention of the vacuum pump, wherein the height of the cylindrical portion is formed so as to be higher than a combined height dimension of the gap and the plate.

The height of the cylindrical portion is formed so as to be higher than the combined height dimension of the gap and the plate. Therefore, even when water droplets land on an upper surface of the plate, the water droplets are not likely to infiltrate beyond the cylindrical portion.

Furthermore, the present invention is the invention of the vacuum pump, wherein a base portion of the pump main body is provided with a base penetrating portion, and the height of the cylindrical portion is formed so as to be higher than a combined height dimension of the gap and the base penetrating portion.

Even when the base portion of the pump main body is provided with the base penetrating portion, by forming the height of the cylindrical portion so as to be higher than the combined height dimension of the gap and the base penetrating portion, the water droplets are not likely to infiltrate beyond the cylindrical portion.

Furthermore, the present invention is the invention of the vacuum pump, wherein the cylindrical portion is constituted by a different member from the chassis of the control apparatus.

Furthermore, the present invention is the invention of the vacuum pump, wherein an attachable and detachable lid is provided with respect to a side portion of the chassis of the control apparatus, the lid has a bent piece at one end thereof, and the bent piece is brought into contact with a surface of the plate.

Providing the side portion of the chassis of the control apparatus with an attachable and detachable lid enables maintenance work such as replacing a circuit board to be performed with greater ease. In addition, since the lid has a bent piece at one end thereof and the bent piece is brought into contact with the surface of the plate, water droplets are unlikely to infiltrate from between the end of the lid and the plate.

Furthermore, the present invention is the invention of the vacuum pump, wherein an attachable and detachable lid is provided with respect to a side portion of the chassis of the control apparatus, the lid has a bent piece at one end thereof, and the bent piece is brought into contact with a surface of the base portion.

Providing the side portion of the chassis of the control apparatus with an attachable and detachable lid enables maintenance work such as replacing a circuit board to be performed with greater ease. In addition, since the lid has a bent piece at one end thereof and the bent piece is brought into contact with the surface of the base portion, water droplets are unlikely to infiltrate from between the end of the lid and the base portion.

Furthermore, the present invention is the invention of the vacuum pump, wherein a lower end of the relay substrate does not protrude downward beyond a bottommost end of the pump main body.

Accordingly, when detaching the plate and placing the pump main body on a table, the pump main body can be placed on the table in a stable manner. A risk of damaging the relay substrate can also be reduced.

Furthermore, the present invention is the invention of the vacuum pump, including a rotor shaft internally mounted to the pump main body and a front panel externally mounted to the control apparatus, wherein the lid is disposed within 90 degrees from a disposition direction of the front panel as viewed from a central axis of the rotor shaft.

A front side of a surface containing the front panel is often opened for convenience of operation and management. Therefore, the lid is disposed within 90 degrees from a disposition direction of the front panel as viewed from the central axis of the rotor shaft. Accordingly, an arrangement can be realized in which the lid and the cover can be readily removed without being obstructed by related apparatuses disposed around the pump main body.

Furthermore, the present invention is a control apparatus having a chassis that is connectible to a pump main body via a predetermined gap, the control apparatus including a cylindrical portion which protrudes from the chassis and inside which a cable to be connected to the pump main body is passed, wherein a height of the cylindrical portion exceeds a height of the gap.

As described above, since the present invention is configured such that the control apparatus includes the cylindrical portion which protrudes from the chassis of the control apparatus and inside which a cable that connects the pump main body and the control apparatus to each other is passed, and a height of the cylindrical portion exceeds a height of the gap formed between the bottom portion of the pump main body and the chassis of the control apparatus, water droplets filling the gap are prevented from infiltrating from the inside of the cylindrical portion.

Accordingly, safety of circuits during maintenance work can be ensured. In addition, a drip-proof structure can be realized with a simple configuration without using a sealing material.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

Figure 1:
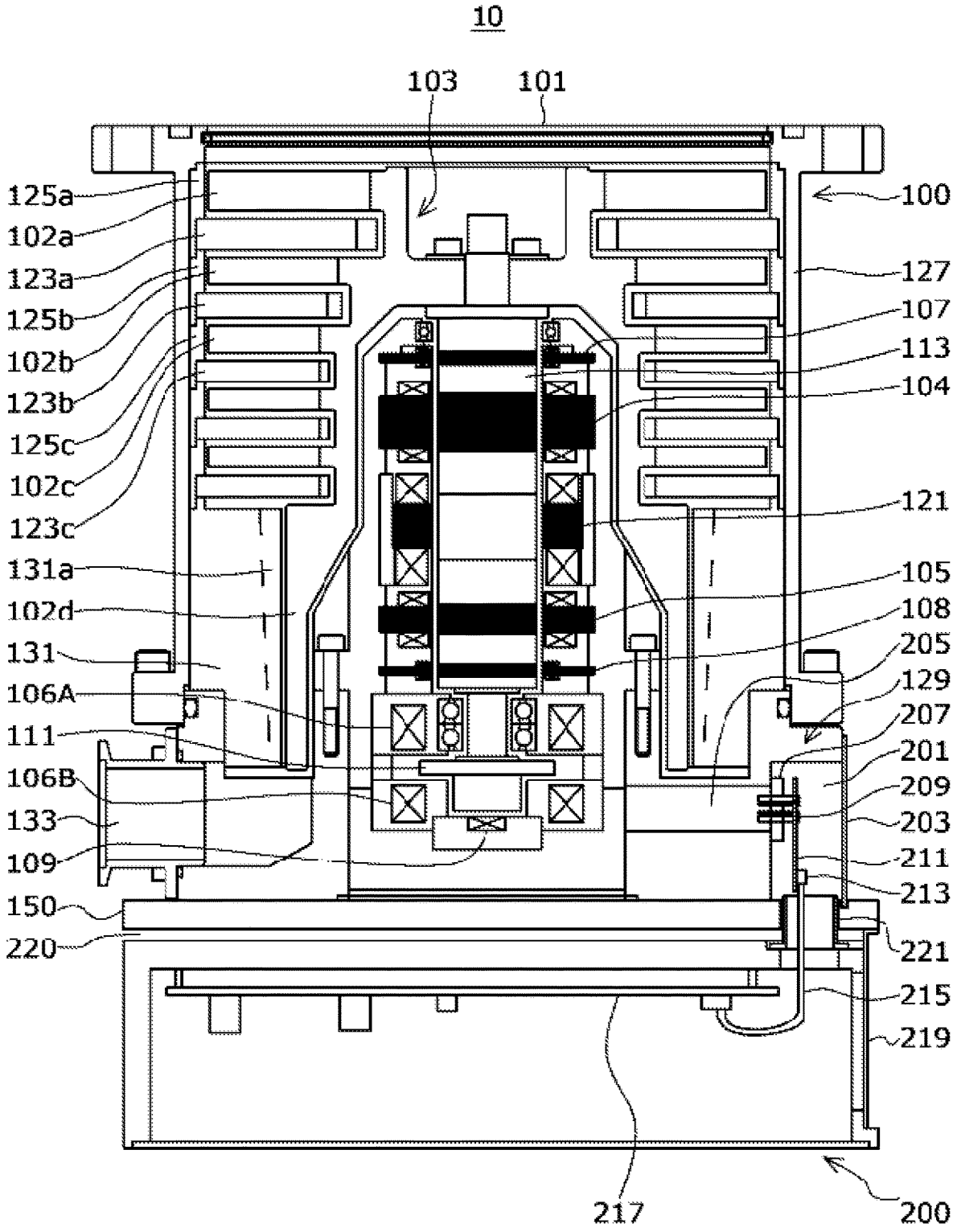
FIG. 1 is a configuration diagram of an embodiment of the present invention.

Hereinafter, an embodiment of the present invention will be described. FIG. 1 shows a configuration diagram of the embodiment of the present invention. In FIG. 1, in a turbo-molecular pump 10, a pump main body 100 and a control apparatus 200 are integrated.

An inlet port 101 is formed at an upper end of a cylindrical outer casing 127 of the pump main body 100. A rotating body 103 in which a plurality of rotor blades 102*a*, 102*b*, 102*c*, . . . constituted by turbine blades for sucking and exhausting gas are radially formed in multiple stages in a circumferential portion inside the outer casing 127.

A rotor shaft 113 is mounted to a center of the rotating body 103 and, for example, a so-called five-axis control magnetic bearing levitates and supports the rotor shaft 113 in midair and controls a position of the rotor shaft 113.

As an upper radial electromagnet 104, four electromagnets are arranged so as to form pairs along mutually orthogonal X and Y axes which are coordinate axes in a radial direction of the rotor shaft 113. An upper radial sensor 107 constituted by four electromagnets is provided in proximity to and in correspondence with the upper radial electromagnet 104. The upper radial sensor 107 is configured to detect a radial displacement of the rotating body 103 and to send the detected radial displacement to the control apparatus 200.

In the control apparatus 200, based on a displacement signal detected by the upper radial sensor 107, excitation of the upper radial electromagnet 104 is controlled via a compensation circuit having a PID adjustment function and a position in the radial direction of an upper side of the rotor shaft 113 is adjusted.

The rotor shaft 113 is formed of a high magnetic permeability material (such as iron) or the like and is configured so as to be attracted by a magnetic force of the upper radial electromagnet 104. The adjustment described above is respectively independently performed in an X axis direction and a Y axis direction.

In addition, a lower radial electromagnet 105 and a lower radial sensor 108 are arranged in a similar manner to the upper radial electromagnet 104 and the upper radial sensor 107 and adjust a position in the radial direction of a lower side of the rotor shaft 113 in a similar manner to the position in the radial direction of the upper side.

Furthermore, axial electromagnets 106A and 106B are arranged so as to vertically sandwich a disc-shaped metal disk 111 provided in a lower part of the rotor shaft 113. The metal disk 111 is constituted by a high magnetic permeability material such as iron. An axial sensor 109 is provided in order to detect an axial displacement of the rotor shaft 113, and the axial sensor 109 is configured such that an axial displacement signal thereof is sent to the control apparatus 200.

The axial electromagnets 106A and 106B are configured so that excitation thereof is controlled based on the axial displacement signal via the compensation circuit having a PID adjustment function of the control apparatus 200. The axial electromagnet 106A and the axial electromagnet 106B respectively attract the metal disk 111 upward and downward by magnetic force.

As described above, the control apparatus 200 is configured to appropriately adjust magnetic forces exerted on the metal disk 111 by the axial electromagnets 106A and 106B to magnetically levitate the rotor shaft 113 in the axial direction and hold the rotor shaft 113 in space in a contactless manner.

A motor 121 includes a plurality of magnetic poles circumferentially arranged so as to surround the rotor shaft 113. Each magnetic pole is controlled by the control apparatus 200 so as to rotationally drive the rotor shaft 113 via an electromagnetic force which acts between the magnetic pole and the rotor shaft 113.

A plurality of stator blades 123*a*, 123*b*, 123*c*, . . . are disposed across small gaps from the rotor blades 102*a*, 102*b*, 102*c*, . . . . The rotor blades 102*a*, 102*b*, 102*c*, . . . are formed inclined by a prescribed angle relative to a plane perpendicular to an axial line of the rotor shaft 113 in order to respectively transport a molecule of exhaust gas downward when the exhaust gas collides.

In addition, the stator blade 123 is also formed inclined by a prescribed angle relative to a plane perpendicular to the axial line of the rotor shaft 113 and is disposed so as to alternate with the stages of the rotor blade 102 toward inside of the outer casing 127.

Furthermore, an end of the stator blade 123 is supported in a state of being fitted and inserted between a plurality of stacked stator blade spacers 125*a*, 125*b*, 125*c*, . . . .

The stator blade spacer 125 is a ring-shaped member constituted by, for example, a metal such as aluminum, iron, stainless steel, or copper or a metal such as an alloy containing these metals as components.

The outer casing 127 is fixed across a small gap in an outer circumference of the stator blade spacer 125. A base portion 129 is disposed in a bottom portion of the outer casing 127, and a threaded spacer 131 is disposed between a lower portion of the stator blade spacer 125 and the base portion 129. In addition, an outlet port 133 which communicates with the outside is formed in a lower portion of the threaded spacer 131 in the base portion 129.

The threaded spacer 131 is a cylindrical member constituted by a metal such as aluminum, copper, stainless steel, or iron or a metal such as an alloy containing these metals as components, and a spiral thread groove 131*a* is engraved in plurality on an inner circumferential surface of the threaded spacer 131.

A direction of the spirals of the thread grooves 131*a* is a direction in which, when a molecule of exhaust gas moves in a direction of rotation of the rotating body 103, the molecule is transported toward the outlet port 133.

A rotor blade 102*d* is suspended from a lowermost portion which continues from the rotor blades 102*a*, 102*b*, 102*c*, . . . of the rotating body 103. An outer circumferential surface of the rotor blade 102*d* is cylindrical in shape and overhangs toward the inner circumferential surface of the threaded spacer 131, and is in proximity to the inner circumferential surface of the threaded spacer 131 across a prescribed gap.

The base portion 129 is a disc-shaped member constituting a base of the turbo-molecular pump 10 and is generally constituted by a metal such as iron, aluminum, or stainless steel.

Since the base portion 129 physically holds the turbo-molecular pump 10 and also has a function of a heat conductive path, a metal having both rigidity and high thermal conductivity such as iron, aluminum, or copper is desirably used.

In the configuration described above, when the rotor blade 102 is driven by the motor 121 and rotates together with the rotor shaft 113, exhaust gas from the chamber is sucked through the inlet port 101 due to actions of the rotor blade 102 and the stator blade 123.

The exhaust gas sucked from the inlet port 101 passes between the rotor blade 102 and the stator blade 123 and is transported to the base portion 129. At this point, while a temperature of the rotor blade 102 rises due to frictional heat generated when the exhaust gas comes into contact or collides with the rotor blade 102, conduction or radiation of heat generated in the motor 121, or the like, this heat is transferred to the side of the stator blade 123 by radiation, conduction by a gas molecule of the exhaust gas, or the like.

The stator blade spacers 125 are joined to one another in an outer circumferential portion and transfers heat received by the stator blade 123 from the rotor blade 102, frictional heat generated when the exhaust gas comes into contact or collides with the stator blade 123, or the like to the outer casing 127 and the threaded spacer 131.

The exhaust gas transported to the threaded spacer 131 is sent to the outlet port 133 while being guided by the thread grooves 131*a*.

In some cases, process gases are introduced in a high-temperature state into a chamber in order to enhance reactivity. In addition, once the process gases are cooled and a temperature thereof drops to a certain level when exhausted, the process gases may solidify and cause a product to be deposited in an exhaust system.

Furthermore, a process gas of this type may cool and solidify inside the turbo-molecular pump 10 and adhere to and accumulate on the interior of the turbo-molecular pump 10.

When a deposit of a process gas accumulates inside the turbo-molecular pump 10, the deposit may narrow a pump flow path and cause a decline in performance of the turbo-molecular pump 10.

When a temperature near the outlet port is low, the product described above readily solidifies and adheres particularly near the rotor blade 102*d* and the threaded spacer 131. In order to solve this problem, conventionally, a heater or an annular water-cooled tube (not shown) is wound around an outer circumference of the base portion 129 or the like and, for example, a temperature sensor (such as a thermistor) (not shown) is embedded in the base portion 129, whereby heating by the heater or cooling by the water-cooled tube is controlled so as to keep the temperature of the base portion 129 at a constant high temperature (set temperature) based on a signal from the temperature sensor.

Figure 2:
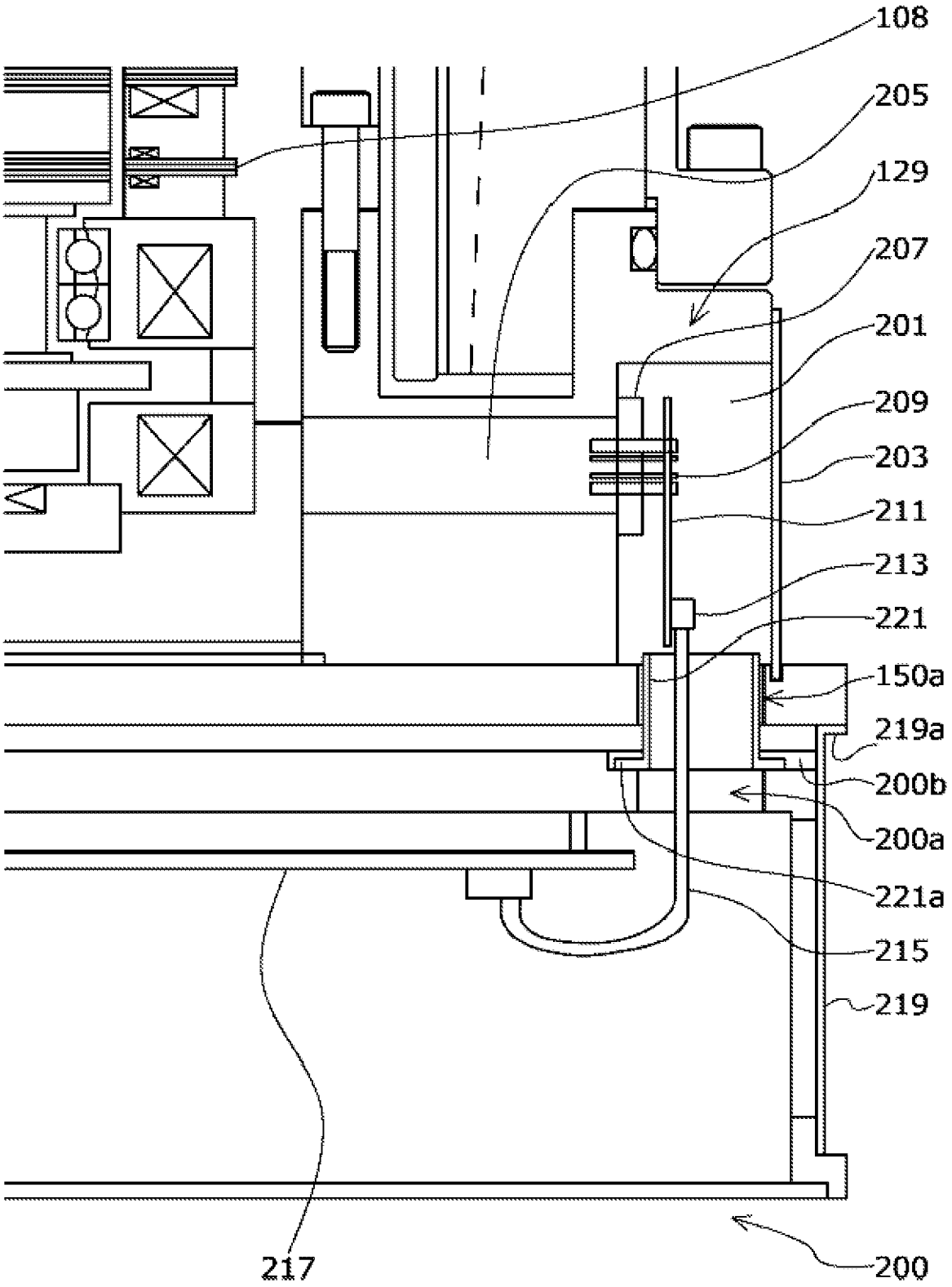
FIG. 2 is an enlarged view of a structural portion around a terminal in FIG. 1.

Next, a structure around terminals to which a control cable and a power cable are to be connected between the pump main body 100 and the control apparatus 200 will be described. FIG. 2 is an enlarged view of a structural portion around the terminal in FIG. 1.

In FIGS. 1 and 2, a plate 150 for aligning fixed positions with the control apparatus 200 is attached to a bottom portion of the base portion 129. A relay chamber 201 is formed in the base portion 129, and the relay chamber 201 is provided with an attachable and detachable cover 203. A space 205 which connects to the relay chamber 201 and which is to be used for wiring of a magnetic bearing, a motor, and the like inside the pump main body 100 is formed inside the base portion 129. The space 205 is hermetically sealed by a hermetic connector 207 (to be described later) and is therefore filled with a vacuum atmosphere but, on the other hand, the control apparatus 200 and the relay chamber 201 are filled with an air atmosphere.

In addition, the hermetic connector 207 is mounted to a wall portion around a right end of the space 205. A large number of pins 209 penetrate the hermetic connector 207. A right end of the pin 209 is exposed and penetrates a small hole (not shown) of a relay substrate 211. The pin 209 is soldered at the small hole portion of the relay substrate 211 with respect to the relay substrate 211 which provides connection to the control apparatus 200.

A terminal 213 is disposed at a lower end of the relay substrate 211 and configured such that one end of a harness 215 is attachable and detachable to and from the terminal 213.

A hole 150*a* that connects to the relay chamber 201 is formed in the plate 150, and a hole 200*a* is formed in a portion of a ceiling wall (chassis) of the control apparatus 200 which faces the hole 150*a*. A depressed portion 200*b* is formed in an upper circumference of the hole 200*a* of the control apparatus 200, and a hollow plate-like portion 221*a* formed in a bottom portion of a cylindrical member 221 is fixed by a bolt (not illustrated) to the depressed portion 200*b*. The cylindrical member 221 penetrates the hole 150*a*, and a height of the cylindrical member 221 is formed higher than an upper surface of the plate 150. The cylindrical member 221 corresponds to the cylindrical portion, and a horizontal sectional shape of the cylindrical member 221 may be any shape including an ellipse or a rectangle.

Another end of the harness 215 passes through the cylindrical member 221 and the hole 200*a*, extends into the control apparatus 200, and connected to a terminal of a circuit board 217 disposed inside the control apparatus 200.

On the other hand, a control cable and a power cable (not shown) are connected to a left end of the pin 209 and passed inside the space 205.

An attachable and detachable lid 219 is disposed in a right-side portion of a chassis that forms the control apparatus 200. A bent piece 219*a* having been bent in an L-shape is provided at an upper end of the lid 219 so as to protrude outward. The lid 219 is screwed to a right end of the chassis of the control apparatus 200, and the bent piece 219*a* is brought into contact with a lower surface of the plate 150.

A gap 220 of around 1 mm is formed to provide heat insulation between the plate 150 and the control apparatus 200. A bottom portion wall of the control apparatus 200 and the plate 150 are fixed by hexagon head bolt columns (not illustrated) having been erected at four corners of the control apparatus 200. The gap 220 is secured by a height of the hexagon head bolt columns.

Next, an action of the embodiment of the present invention will be described.

Disposing the plate 150 in the bottom portion of the pump main body 100 enables the pump main body 100 and the control apparatus 200 to be integrated by simply changing the plate 150 even when sizes of the pump main body 100 and the control apparatus 200 differ from each other. Therefore, for example, a single control apparatus 200 can be freely combined with pump main bodies 100 of different capacities. The plate 150 is detachably fastened to the pump main body 100 by bolts.

A configuration can be adopted in which the lower end of the relay substrate 211 is extended downward so as to penetrate the inside of the cylindrical member 221. However, with the configuration in which the lower end of the relay substrate 211 is extended downward, for example, when removing the plate 150 and placing the pump main body 100 on a table during an operation to attach and detach the pump main body 100 and the control apparatus 200, the lower end portion of the relay substrate 211 not only comes into contact with the table first and prevents the pump main body 100 from being placed on the table in a stable manner but may also damage the relay substrate 211.

In consideration thereof, desirably, the lower end of the relay substrate 211 does not protrude in an axial direction beyond the upper surface of the plate 150 or the bottom surface of the pump main body 100.

Cooling by a water-cooled tube may cause condensation to form around the base portion 129. In addition, there is a risk that water droplets may leak from the water-cooled tube during maintenance. Leaked water droplets are highly likely to infiltrate into the gap 220. In particular, when the lid 219 has been removed, the likelihood of infiltration by water droplets further increases. In this case, while the water droplets are likely to flow into the depressed portion 200*b*, since the hollow plate-like portion 221*a* and the depressed portion 200*b* are hermetically fixed to each other by respective metal surfaces with bolts (not illustrated), water droplets are unlikely to infiltrate into the control apparatus 200.

Furthermore, a greater hermetic effect is exhibited by increasing respective flatnesses of the bottom surface of the hollow plate-like portion 221*a* and the depressed portion 200*b*.

In addition, in case water droplets infiltrate the gap 220, an incline may be provided in a direction perpendicular to the lid 219 in order to produce a drainage effect.

In addition, since the cylindrical member 221 penetrates the gap 220 and is formed higher than the thickness of the gap 220, water droplets that fill the gap 220 are prevented from infiltrating from inside the cylindrical member 221. Furthermore, even when water droplets land on the upper surface of the plate 150, since the cylindrical member 221 is provided so as to protrude higher than the upper surface of the plate 150, the water droplets are not likely to infiltrate beyond the cylindrical member 221.

In addition, since the bent piece 219*a* having been bent in an L-shape is provided so as to protrude outward at an upper end of the lid 219 on a side of the pump main body 100, water droplets are unlikely to infiltrate into the control apparatus 200. Furthermore, since the bent piece 219*a* and the plate 150 are hermetically fixed to each other by respective metal surfaces with bolts (not illustrated), water droplets are also unlikely to infiltrate from between the upper end of the lid 219 and the plate 150. Moreover, as will be described later, even in a configuration in which the base portion 129 is deformed without providing the plate 150, a similar effect can be obtained by bringing the bent piece 219*a* into contact with the bottom surface of the base portion 129.

As described above, a drip-proof structure can be inexpensively realized by a component configuration solely based on metal working such as sheet metal pressing and without the use of a sealing material. In addition, an operation to attach and detach the harness 215 by removing the cover 203 can be readily performed while providing a drip-proof function. Accordingly, the control apparatus 200 can be readily detached. Furthermore, even during on-site maintenance work, work such as replacing a circuit board inside the control apparatus 200 can be readily performed by opening the lid 219 while providing a drip-proof function.

In the embodiment of the present invention, the plate 150 is described as a member that is independent from the pump main body 100. However, as represented by another embodiment shown in FIG. 3, the base portion 129 of the pump main body 100 is deformed without providing the plate 150 as a separate member. In addition, the plate 150 may be disposed with respect to the pump main body 100 as a base bottom portion 151. In this case, in a similar manner to a case where the plate 150 is interposed, a bottom portion wall of the control apparatus 200 and the base bottom portion 151 are fixed by hexagon head bolt columns (not illustrated) having been erected at four corners of the control apparatus 200. Furthermore, the gap 220 is secured by the height of the hexagon head bolt columns. In addition, the base bottom portion 151 is provided with a hole 151*a* that connects to the relay chamber 201.

Figure 3:
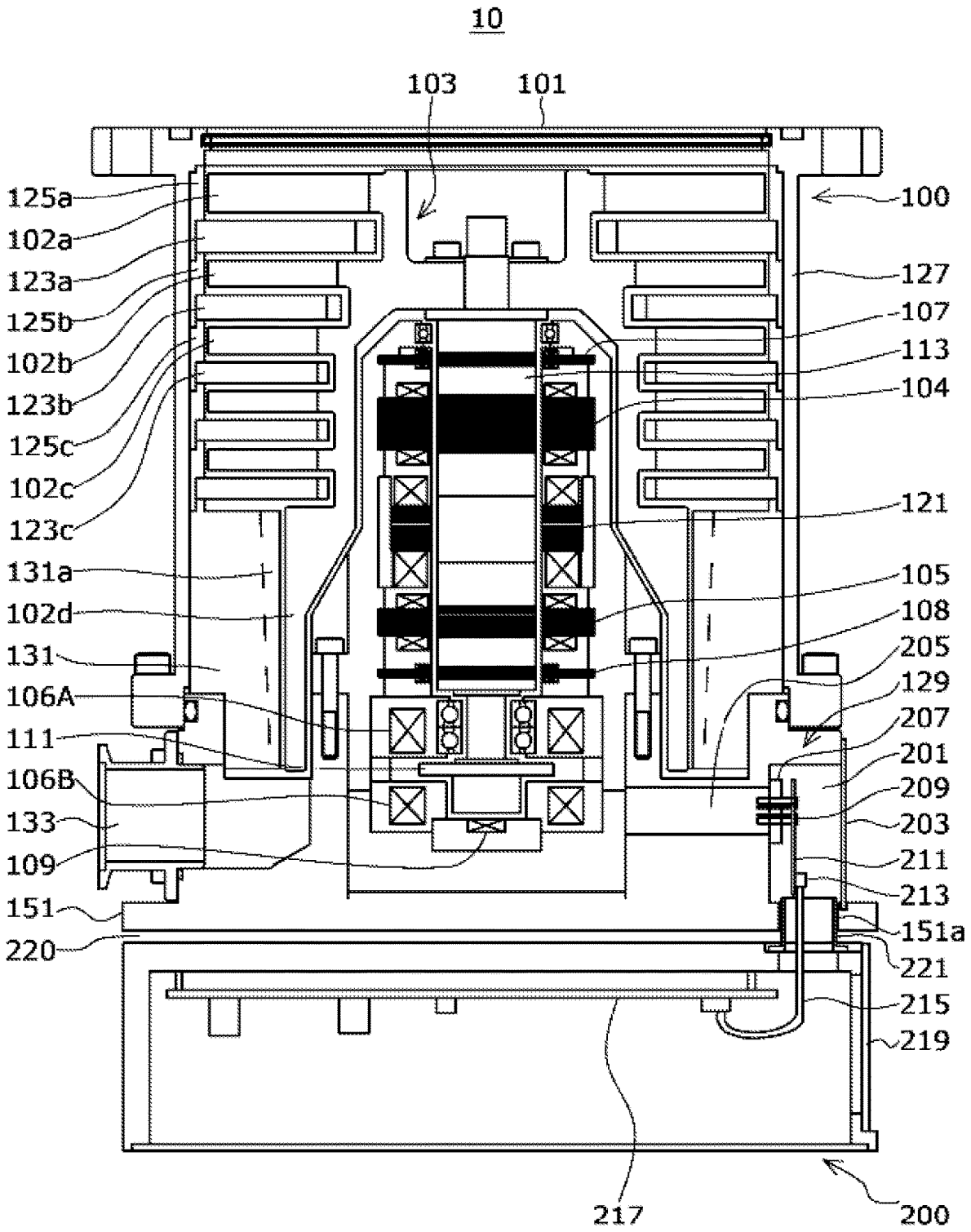
FIG. 3 is a configuration diagram of another embodiment.

It should be noted that, in FIG. 3, elements that are the same as those in FIG. 1 will be denoted by same reference signs and descriptions thereof will be omitted.

In this case, the lower end of the relay substrate 211 desirably ends on an inner side of the pump instead of an upper surface of the hole 151*a* in a similar manner to that described earlier.

Figure 4:
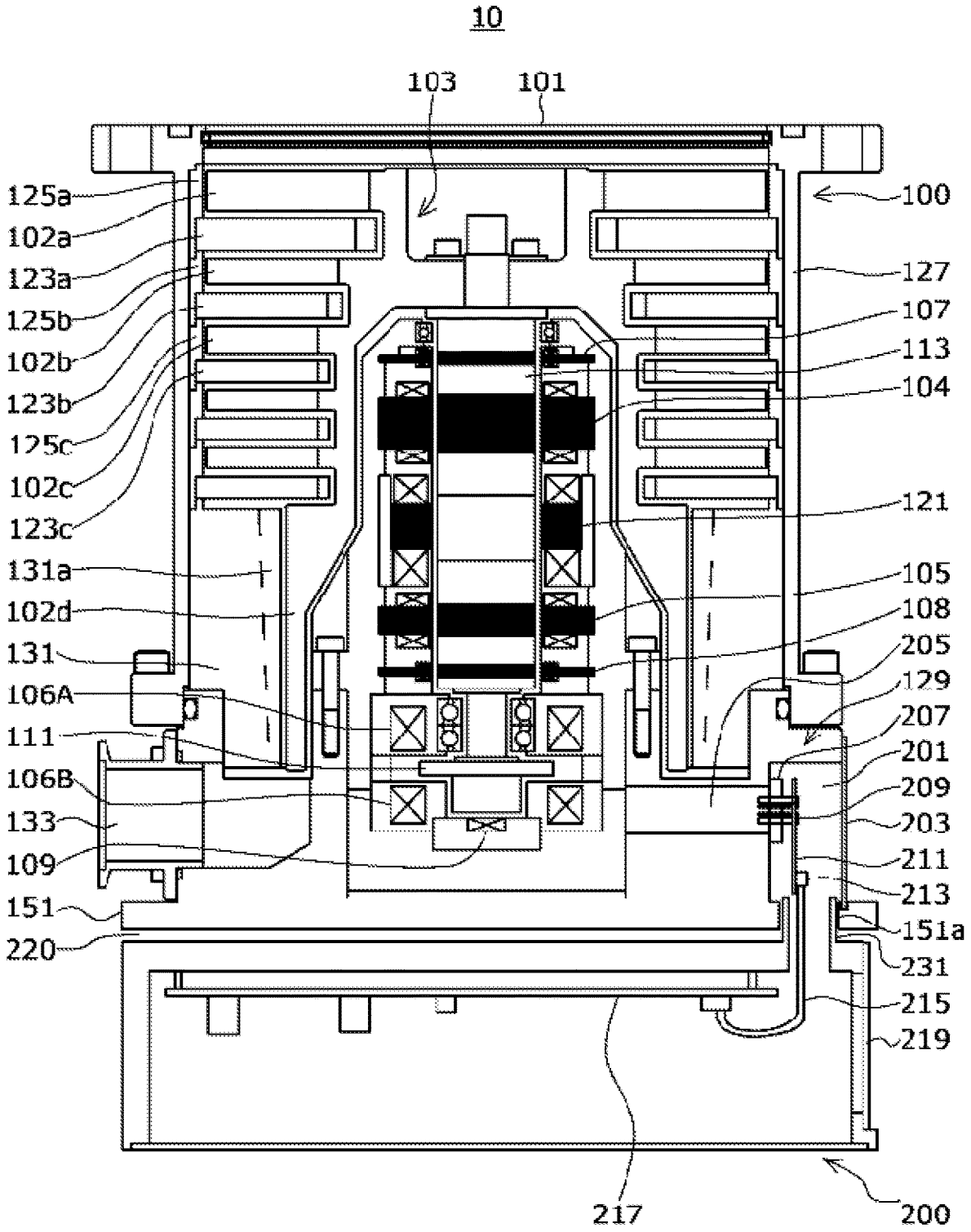
FIG. 4 is a configuration diagram of yet another embodiment.

Furthermore, while the cylindrical member 221 is configured as an independent member in the embodiment of the present invention, as represented by another embodiment shown in FIG. 4, a cylindrical portion 231 may be provided so as to protrude from the ceiling wall of the control apparatus 200. A horizontal sectional shape of the cylindrical portion 231 may be any shape including an ellipse or a rectangle. It should be noted that, in FIG. 4, elements that are the same as those in FIG. 1 will be denoted by same reference signs and descriptions thereof will be omitted.

In this case, the ceiling wall and the cylindrical portion 231 are integrally formed. While FIG. 4 shows an example in which the plate 150 is not provided but integrally formed with the pump main body 100 as the base bottom portion 151 of the pump main body 100 in a similar manner to FIG. 3, alternatively, a configuration may be adopted in which the plate 150 being a member that is independent from the pump main body 100 is provided in a similar manner to FIGS. 1 and 2.

Next, a suitable arrangement method of the relay chamber 201, the lid 219, and the cover 203 will be described.

Figure 5:
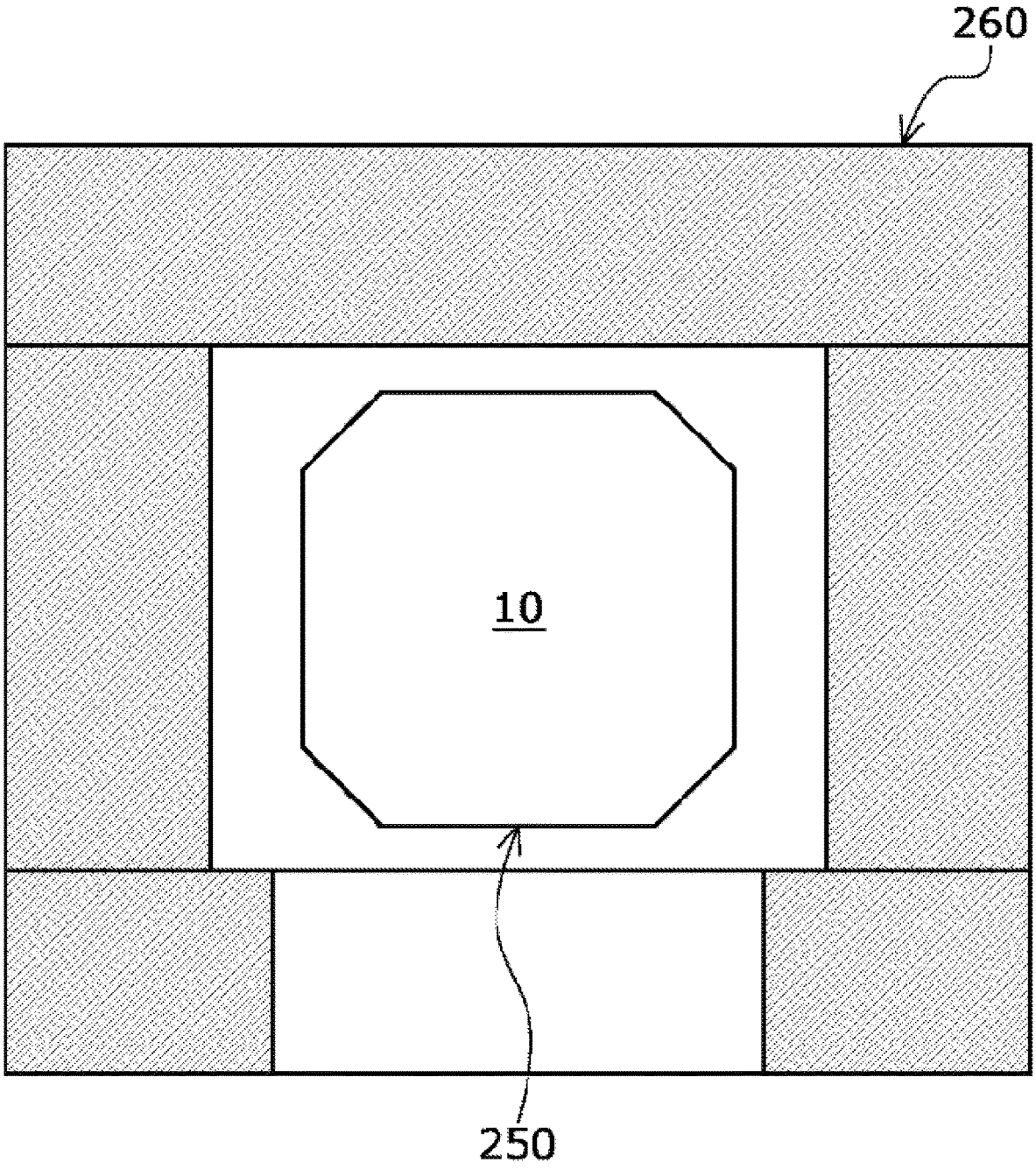
FIG. 5 is a top view of a turbo-molecular pump and control apparatus (hidden from view) showing an arrangement of equipment apparatuses around the turbo-molecular pump and control apparatus.

Generally, various apparatuses and equipment 260 such as a power supply and piping are arranged around a chamber of a semiconductor manufacturing apparatus. In such an environment, the turbo-molecular pump 10 is often suspended in a lower part of the chamber. In such a case, for example, as shown in FIG. 5, a situation may occur in which surfaces other than a surface provided with a panel (a front panel 250) on which a power supply switch, a connector for connecting to the power supply, a cable connector for communication with the semiconductor manufacturing apparatus, and the like of the control apparatus 200 are concentrated are surrounded by the apparatuses and equipment 260. This is because at least a front side of the surface containing the front panel 250 needs to be opened for convenience of operation and management.

Figure 6:
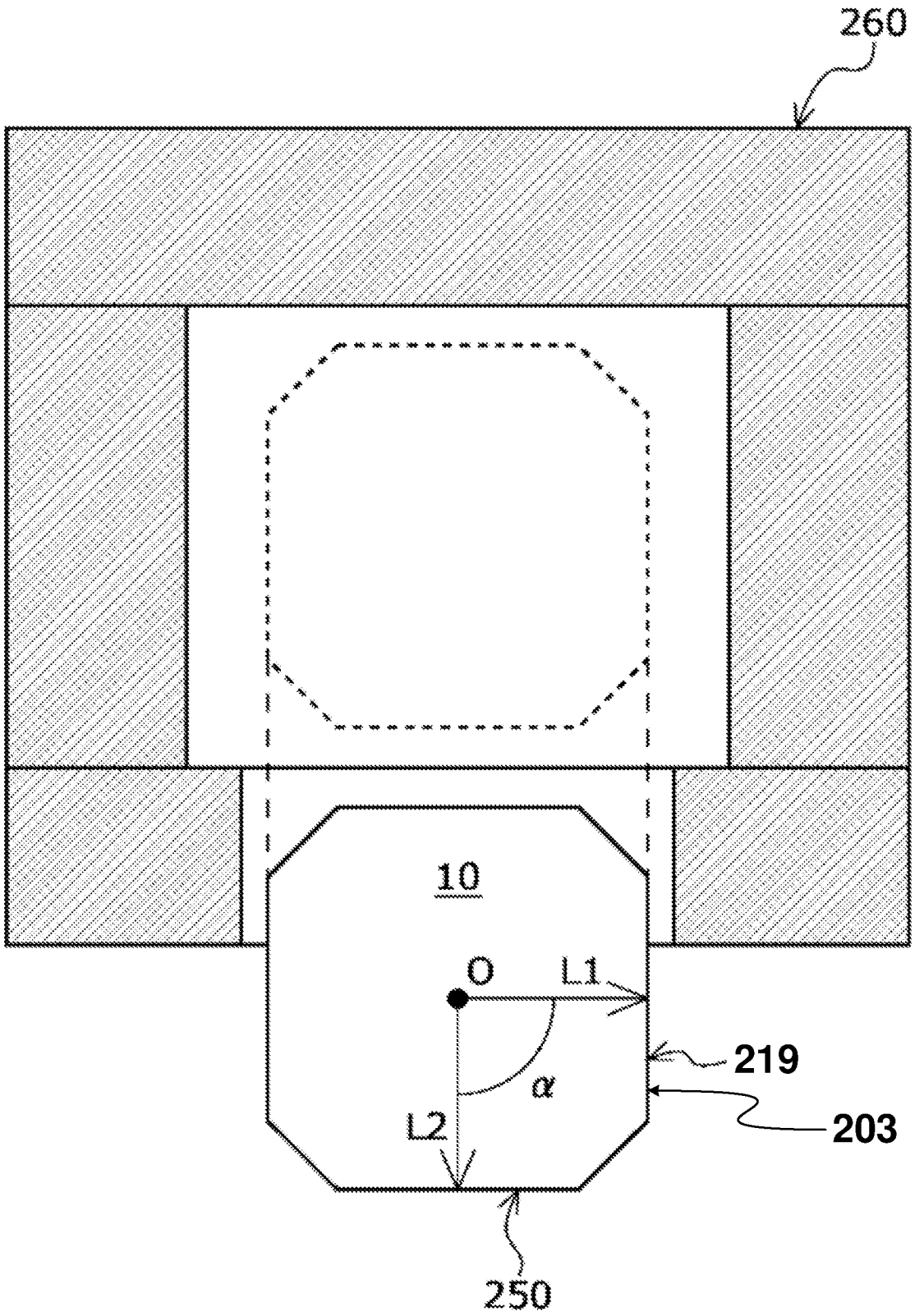
FIG. 6 is a top view of the arrangement of equipment of FIG. 5 showing a situation where the turbo-molecular pump and the control apparatus are pulled out to a front panel side.

In such a case, in order to replace a circuit component on-site, desirably, only the control apparatus 200 is attachable and detachable in a state where the pump main body 100 is suspended in the lower part of the chamber. In addition, to this end, desirably, the lid 219 and the cover 203 are arranged so as to be readily removable without being obstructed by the apparatuses and equipment 260. As shown in FIG. 6, the control apparatus 200 can be readily pulled out toward a front side that is a disposition direction of the front panel 250 relative to the apparatuses and equipment 260.

In this case, by disposing the relay chamber 201, the lid 219, and the cover 203 at positions close to the surface of the front panel 250 of the control apparatus 200, a worker can access the relay chamber 201, the lid 219, and the cover 203 from an opened portion and on-site maintenance work can be readily performed. In other words, as shown in FIG. 6, when taking ease of maintenance work into consideration, an angle α formed between a disposition direction L1 of the relay chamber 201, the lid 219, and the cover 203 and a disposition direction L2 of the front panel 250 as viewed from a center point O of the rotor shaft 113 of the turbomolecular pump 10 is desirably within 90 degrees.

Moreover, it will be obvious to those skilled in the art that various changes and modifications may be made and embodiments may be combined without departing from the spirit of the present invention and that the present invention also encompasses such changes and modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump in which a pump main body and a control apparatus that controls the pump main body are integrated with each other, wherein the pump main body includes a hermetic connector having a plurality of pins, a relay substrate is connected to the plurality of pins, the relay substrate is connected to the control apparatus by a cable, the control apparatus includes a cylindrical portion which protrudes from a chassis of the control apparatus through a hole in a bottom portion of the pump main body wherein the cable passes from the control apparatus into both the cylindrical portion and the hole, and wherein the hermetic connector is above an entirety of the cylindrical portion and the cable is loose of the cylindrical portion, a height of the cylindrical portion exceeds a height of a gap formed between the bottom portion of the pump main body and the chassis of the control apparatus, and the cylindrical portion comprises a hollow plate-like portion configured to prevent water droplets from infiltrating into the control apparatus.

2. The vacuum pump according to claim 1, wherein the pump main body includes a relay chamber which houses the relay substrate, and the relay chamber is provided with a detachable cover.

3. The vacuum pump according to claim 2, wherein a lower end of the relay substrate does not protrude downward beyond a bottommost end of the pump main body.

4. The vacuum pump according to claim 1, wherein the bottom portion of the pump main body comprises a detachable plate.

5. The vacuum pump according to claim 4, wherein an attachable and detachable lid is provided with respect to a side portion of the chassis of the control apparatus, the lid has a bent piece at one end thereof, and the bent piece is brought into contact with a surface of the detachable plate.

6. The vacuum pump according to claim 5, comprising a rotor shaft internally mounted to the pump main body and a front panel externally mounted to the control apparatus, wherein the lid is disposed within 90 degrees from a disposition direction of the front panel as viewed from a central axis of the rotor shaft.

7. The vacuum pump according to claim 4, wherein the height of the cylindrical portion is formed so as to be higher than a combined height dimension of the gap and the plate.

8. The vacuum pump according to claim 1, wherein the bottom portion of the pump main body comprises a base portion of the pump main body, the base portion comprises the hole, and the height of the cylindrical portion is formed so as to be higher than a combined height dimension of the gap and the hole.

9. The vacuum pump according to claim 8, wherein an attachable and detachable lid is provided with respect to a side portion of the chassis of the control apparatus, the lid has a bent piece at one end thereof, and the bent piece is brought into contact with a surface of the base portion.

10. The vacuum pump according to claim 1, wherein the cylindrical portion is constituted by a different member from the chassis of the control apparatus.

* * * * *